US005225641A

United States Patent [19]

Weld et al.

[11] Patent Number: 5,225,641

[45] Date of Patent: Jul. 6, 1993

[54] FLUID FLOW SWITCH ASSEMBLY

[75] Inventors: Rodney C. Weld, Edwardsburg; Richard A. Zander, Niles, both of Mich.

[73] Assignee: Allied-Signal Inc., Morristown, N.J.

[21] Appl. No.: 903,411

[22] Filed: Jun. 24, 1992

[51] Int. Cl.[5] ..... H01H 35/38

[52] U.S. Cl. ..... 200/81.9 R; 73/861.47; 200/82 R; 200/302.1

[58] Field of Search ..... 340/606, 608, 611; 307/118; 417/40; 73/861.47, 239; 200/81.9 R, 82 R, 82 D, 302.1, 275; 92/5 R

[56] References Cited

U.S. PATENT DOCUMENTS 4,780,578 10/1988 Heskel ..... 200/302.1

FOREIGN PATENT DOCUMENTS 553583 5/1943 United Kingdom ..... 200/81.9 R 2162692 2/1986 United Kingdom ..... 200/81.9 R

*Primary Examiner*—Gerald P. Tolin

*Attorney, Agent, or Firm*—Larry J. Palguta; Ken C. Decker

[57] ABSTRACT

The flow switch assembly (10) of a fluid power apparatus comprises a fluid flow pressure operated switch (10) which activates upon the failure or degradation of fluid flow. A body (14) contains therein a blind bore (15) which receives a piston (71) biased by a spring (17) located at the bottom (13) of the bore (15). A switch housing (11) which is molded about a contact (20) is threadedly inserted into an open threaded end (16) of the bore (15). The bore (15) communicates with a fluid flow opening such that fluid pressure causes the piston (71) to retract against the spring (17). The contact (20) extends axially beyond a wall (11A) of the switch housing (11) such that a radially enlarged portion (21) provides a seat for a seal (30) which sealingly engages the radially enlarged portion (21) and a surface of the bore (15). If fluid flow should cease or fall below a predetermined pressure level, the piston (71) is displaced by the spring (17) and engages the contact (20) to complete a circuit and energize an electric motor pump which provides fluid pressure to the associated fluid power apparatus.

4 Claims, 1 Drawing Sheet

FLUID FLOW SWITCH ASSEMBLY

Figure 1:
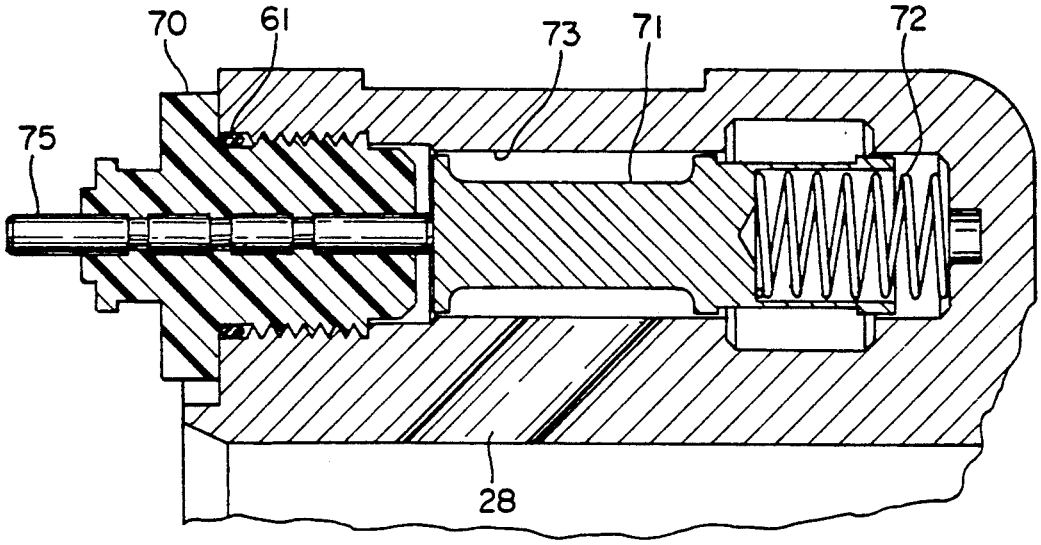
FIG. 1 PRIOR ART

The present invention relates generally to a fluid flow switch assembly, and in particular to a fluid flow switch assembly for a fluid power apparatus.

A fluid power apparatus may be operated by means of fluid pressure provided by a vehicle's power steering pump, by a dedicated electric pump, or by an electric motor pump which serves as a backup pump in case of failure of the main pressure source. Isakson U.S. Pat. No. 4,961,846 incorporated by reference herein discloses a fluid power apparatus which is operated by means of fluid pressure from a power steering pump. As illustrated in Isakson U.S. Pat. No. 4,961,846 and FIG. 1 herein, a flow switch 70 includes a contact 75 which may be engaged by a spring 72 biased piston 71 should adequate pressure fail to be provided by the power steering pump. In the absence of either fluid pressure or sufficient fluid pressure via opening 28 and which normally causes piston 71 to retract against the spring 72, piston 71 is displaced by spring 72 such that it engages the contact 75 of flow switch 70 and energizes an electric pump which then provides fluid pressure to the fluid power apparatus. The flow switch 70 includes a switch housing made of Nylon® which typically includes a mold line therealong. The seal 61 disposed about the switch housing is lifted slightly away from the switch housing by the material at the mold line and this may result in a leakage of fluid between the molded switch housing and seal. Additionally, the switch housing may shrink slightly such that fluid may leak between the switch housing and contact assembly. It is highly desirable to provide a flow switch assembly which prevents any leakage of fluid from the seal/switch housing interface and also from the switch contact/switch housing interface. Additionally, it is desirable to provide a smaller seal such that fluid pressure acting thereon may be reduced.

The present invention provides solutions to the above problems by providing a fluid flow switch assembly, comprising a body having therein a bore, the bore communicating with a fluid flow opening, a piston disposed in said bore and biased by resilient means, one end of the bore enclosed by a switch housing, the switch housing having therein a switch contact, the switch contact extending at one end exteriorly of said switch housing and body and extending at the other end from said switch housing and into said bore, the other end of the contact comprising a radially enlarged portion which extends axially to a radially enlarged shoulder, seal means disposed about said radially enlarged portion to sealingly engage the other end of the contact and a surface of said bore, so that fluid flow through said bore retains the piston in a retracted position and a reduction in fluid flow below a predetermined level permits the resilient means to displace said piston into engagement with said contact.

One way of carrying out the invention is described in detail below with reference to the drawings which illustrate an embodiment in which:

FIG. 1 is an illustration of the prior switch construction of U.S. Pat. No. 4,961,846; and FIG. 2 illustrates the fluid flow switch assembly of the present invention.

Figure 2:
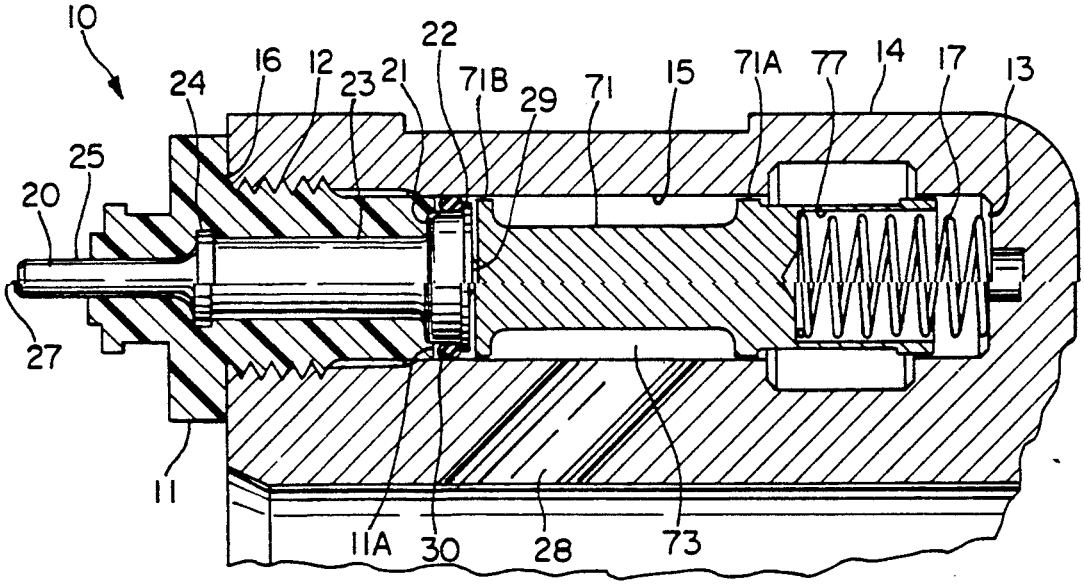

Referring to FIG. 2, the fluid power apparatus includes a body or apparatus housing 14 which includes therein blind bore 15 having open threaded end 16.

Blind bore 15 communicates with fluid flow opening 28 through which fluid passes on its way to a not shown fluid power outlet. The fluid pressure is provided by means of the power steering pump of an associated vehicle. Located within blind bore 15 is spring or resilient means 17 which engages bottom 13 of bore 15. The opposite end of spring 17 is received within recess 77 of piston 71 located within blind bore 15. Spring 17 biases piston 71 toward open threaded end 16 of bore 15. Piston 71 includes radial flanges 71A and 71B which are acted upon by fluid pressure from opening 28 and result in piston 71 being moved or displaced to a retracted position away from open threaded end 16 of bore 15. A fluid flow switch assembly designated generally by reference numeral 10 includes switch housing 11 having threads 12 threadedly received at open threaded 16. Switch housing 11 is made of a glass-filled Nylon® and is molded about contact 20. Contact 20 comprises radially enlarged portion or second large diameter 21 which extends axially beyond radially extending wall 11A of switch housing 11. Portion 21 extends axially to a first large diameter or radially enlarged shoulder 22. Contact 20 is a longitudinally extending member having progressively smaller diameter portions comprising first of all the radially enlarged shoulder or first large diameter 22, a second large diameter comprising the radially enlarged portion 21, a third large diameter 23 located between radially enlarged portion 21 and an intermediate radially extending flange 24, and a fourth diameter portion 25 extending between flange 24 and contact end 27 which is located exteriorly of switch housing 11 and body 14. Radially enlarged portion 21 of contact 20 provides a seat for seal 30 which sealingly engages radially enlarged portion 21 and the surface of bore 15. Seal 30 is retained axially in place by radial extending wall 11A and shoulder 22 of contact 20. The area of blind bore 15 located between seal 30 and bottom 13 of bore 15 comprises pressure chamber 73.

During operation of the associated not shown fluid power apparatus, pressurized fluid is transmitted by a not shown power steering pump through opening 28 and to chamber 73, to be subsequently emitted by the not shown fluid power outlet which communicates with blind bore 15. The fluid pressure causes piston 71 to be displaced to a retracted position relative to bottom 13 of bore 15 such that piston 71 does not engage contact 20 at contact abutment 29. During normal operation of the fluid power apparatus, piston 71 remains displaced from and out of engagement with contact 20. However, should fluid pressure fail to be transmitted to opening 28 because of a failure of the power steering pump, or should the transmitted fluid pressure fall below a predetermined pressure level, piston 71 will be extended or displaced by spring 17 such that it engages contact 20 at abutment 29. A low energy current is present and passing through housing 14 so that a circuit is completed between the current flowing through housing 14 and a not shown wire connected to end 27 of contact 20. The completed circuit causes a not shown electric motor pump to be energized and the electric motor pump provides fluid pressure to the fluid power apparatus.

The fluid flow switch assembly of the present invention provides substantial advantages over the prior flow switch assembly illustrated in FIG. 1. Seal 30 is no longer located about flow switch housing 11 and therefore a flash line resulting from the molding of the switch housing can no longer permit fluid to leak from between the seal and switch housing. Additionally, because seal 30 is now sealingly in engagement with contact 20, fluid cannot leak out via the contact/switch housing interface after the switch housing experiences some shrinkage. Thus, seal 30 of the fluid flow switch assembly of the present invention provides a dual function by effecting sealing between the contact and surface of the bore such that fluid cannot leak from between a seal/switch housing interface or from a switch housing/contact interface. Additionally, because the 0-ring seal is located further interiorly of bore 15 and has a smaller diameter, it may be subject to less fluid pressure and this further reduces a possibility of fluid leakage.

We claim:

1. A fluid flow switch assembly, comprising a body having therein a bore, the bore communicating with a fluid flow opening, a piston disposed in said bore and biased by resilient means, one end of the bore enclosed by a switch housing, the switch housing having therein a switch contact, the switch contact extending at one end exteriorly of said switch housing and body and extending at the other end from said switch housing and into said bore, the other end of the contact comprising a radially enlarged portion which extends axially to a radially enlarged shoulder, seal means disposed about said radially enlarged portion to sealingly engage the other end of the contact and a surface of said bore, so that fluid flow through said bore retains the piston in a retracted position and a reduction in fluid flow below a predetermined level permits the resilient means to displace said piston into engagement with said contact.

2. The fluid flow switch assembly in accordance with claim 1, wherein the contact further includes an intermediate radially extending flange and the switch housing molded about said contact, so that the contact is located in a stationary position relative to said bore as a result of the switch housing being fixed to said body.

3. The fluid flow switch assembly in accordance with claim 2, wherein said switch housing includes a radially extending wall at an end of the housing adjacent the other end of said contact, such that the seal means is maintained axially in place between the radially extending wall and radially enlarged shoulder of the contact.

4. The fluid flow switch assembly in accordance with claim 3, wherein said contact comprises a longitudinally extending member having progressively smaller diameters along the length thereof, such that a first large diameter comprises the radially enlarged shoulder, a second large diameter comprises the radially enlarged portion, a third large diameter comprises a portion between said radially enlarged portion and said intermediate radially extending flange, and a fourth diameter comprises a portion between the intermediate radially extending flange and the one end of the switch contact.

* * * * *